US008950831B2

(12) United States Patent
Kim et al.

(10) Patent No.: US 8,950,831 B2
(45) Date of Patent: Feb. 10, 2015

(54) WASHING MACHINE

(75) Inventors: Sung Ryong Kim, Seoul (KR); Dong Won Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 419 days.

(21) Appl. No.: 13/146,783

(22) PCT Filed: May 11, 2010

(86) PCT No.: PCT/KR2010/002969

§ 371 (c)(1),
(2), (4) Date: Jul. 28, 2011

(87) PCT Pub. No.: WO2010/131883

PCT Pub. Date: Nov. 18, 2010

(65) Prior Publication Data

US 2011/0298338 A1 Dec. 8, 2011

(30) Foreign Application Priority Data

May 11, 2009 (KR) ..... 10-2009-0040760

(51) Int. Cl.

*A47B 77/06* (2006.01)
*D06F 39/12* (2006.01)
*D06F 29/00* (2006.01)
(Continued)

(52) U.S. Cl.

CPC ..... *D06F 39/12* (2013.01); *D06F 29/00* (2013.01); *D06F 37/18* (2013.01); *D06F 37/28* (2013.01); *D06F 39/14* (2013.01); *D06F 37/266* (2013.01)

USPC ..... 312/228; 312/296; 68/13 R; 68/27; 68/196

(58) Field of Classification Search

USPC ..... 312/228, 228.1, 107, 319.1–319.2, 312/319.4, 296, 291–292, 301, 306–307, 312/401–402; 68/3 R, 13 R, 27, 196

See application file for complete search history.

(56) References Cited

U.S. PATENT DOCUMENTS 4,526,020 A 7/1985 Fey et al. ..... 68/3 R
6,447,081 B1 * 9/2002 Sargeant et al. ..... 312/228.1
(Continued)

FOREIGN PATENT DOCUMENTS

EP 1700558 A2 * 9/2006
EP 1 790 272 A2 5/2007
(Continued)

OTHER PUBLICATIONS

International Application issued in PCT Appln. No. PCT/KR2010/002969 dated Oct. 28, 2010.
(Continued)

*Primary Examiner* — Darnell Jayne
*Assistant Examiner* — Ryan A Doyle
(74) *Attorney, Agent, or Firm* — Ked & Associates, LLP

(57) ABSTRACT

The present invention relates to a washing machine which can close/open a lid on a supplementary washing machine automatically at the time the supplementary washing machine is opened/closed. The washing machine includes a cabinet which forms an exterior of the washing machine, a supplementary washing machine removably mounted to a lower side of the cabinet, having a lid for introducing laundry and a tub for holding the laundry, and an automatic opening/closing member for slidably opening/closing the lid at the time the supplementary washing machine is opened/closed.

18 Claims, 12 Drawing Sheets

(51) Int. Cl.

| | |
|---|---|
| ***D06F 37/18*** | (2006.01) |
| ***D06F 37/28*** | (2006.01) |
| ***D06F 39/14*** | (2006.01) |
| ***D06F 37/26*** | (2006.01) |

(56) References Cited

U.S. PATENT DOCUMENTS

| | | | | |
|---|---|---|---|---|
| 6,460,555 | B1 * | 10/2002 | Tuller et al. | 134/200 |
| 6,491,049 | B1 * | 12/2002 | Tuller et al. | 134/200 |
| 2001/0045226 | A1 * | 11/2001 | Todd | 134/201 |
| 2002/0042957 | A1 * | 4/2002 | Kim et al. | 8/158 |
| 2006/0151011 | A1 * | 7/2006 | Maunsell et al. | 134/56 D |
| 2006/0174663 | A1 * | 8/2006 | Cimetta et al. | 68/3 R |
| 2007/0151300 | A1 * | 7/2007 | Sunshine | 68/3 R |
| 2008/0035189 | A1 * | 2/2008 | Gunnerson et al. | 134/56 D |
| 2008/0159907 | A1 | 7/2008 | Joshi et al. | 422/5 |
| 2009/0007602 | A1 * | 1/2009 | Woo et al. | 68/208 |
| 2009/0113945 | A1 * | 5/2009 | Kim et al. | 68/5 C |
| 2009/0145174 | A1 * | 6/2009 | Kim et al. | 68/27 |
| 2009/0146536 | A1 * | 6/2009 | Kim et al. | 312/228 |
| 2009/0158784 | A1 * | 6/2009 | Kim et al. | 68/27 |
| 2010/0064736 | A1 * | 3/2010 | Jeong et al. | 68/13 R |
| 2010/0083992 | A1 * | 4/2010 | Wrangberth et al. | 134/198 |
| 2011/0127891 | A1 * | 6/2011 | Cosgrove | 312/228 |
| 2011/0265524 | A1 * | 11/2011 | Kim et al. | 68/13 R |
| 2012/0234054 | A1 * | 9/2012 | Kim et al. | 68/5 C |

FOREIGN PATENT DOCUMENTS

| | | | | |
|---|---|---|---|---|
| JP | 2002-282192 | A | 10/2002 | |
| JP | 2006-075640 | A | 3/2006 | |
| JP | 2007-130359 | | 5/2007 | |
| JP | 2008-200388 | A | 9/2008 | |
| KR | 2008-0052967 | | 6/2008 | |
| WO | WO 2006/057567 | | 6/2006 | |
| WO | WO 2008/069607 | A2 | 6/2008 | |
| WO | WO 2008067894 | * | 6/2008 | |
| WO | WO 2008084932 | A2 * | 7/2008 | D06F 31/00 |
| WO | WO 2008/143436 | A2 | 11/2008 | |
| WO | WO 2008/150184 | | 12/2008 | |

OTHER PUBLICATIONS

European Search Report dated Jul. 7, 2014, issued in Application No. 10775085.3.

* cited by examiner

WASHING MACHINE

TECHNICAL FIELD

The present invention relates to washing machines, and, more particularly, to a washing machine which can close/open a lid on a supplementary washing machine automatically at the time the supplementary washing machine is opened/closed.

BACKGROUND ART

Currently, a washing machine is provided to consumers, which additionally has a supplementary washing machine on a lower side of a cabinet for making separate washing of a small amount of laundry. The use of the supplementary washing machine enables to improve energy efficiency since the washing machine may not be used for washing the small amount of laundry, which permits to reduce consumption of washing water.

DISCLOSURE OF INVENTION

Technical Problem

In the meantime, most of the related art supplementary washing machines are of drawer types which are coupled like drawers. For using the supplementary washing machine, the user is required to open the drawer at first, and, then, a lid, which is an inner cover, for introducing laundry.

Therefore, the related art supplementary washing machine is inconvenience of opening the drawer at first and, then, opening the lid again.

Solution to Problem

Accordingly, the present invention is directed to a washing machine.

An object of the present invention is to provide a washing machine which can open/close a lid on a supplementary washing machine automatically at the time the supplementary washing machine is opened/closed.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine includes a cabinet which forms an exterior of the washing machine, a supplementary washing machine having a drawer removably mounted to a lower side of the cabinet, a tub for holding laundry, and a lid for introducing the laundry to the tub, and an automatic opening/closing member for slidably opening/closing the lid at the time the supplementary washing machine is opened/closed.

The washing machine further includes a gasket mounted along a circumference of an opening through which the laundry is introduced, for preventing washing water from leaking to an outside of the tub.

The lid includes a tubular sealer for sealing between the tub and the lid when the lid is closed.

The gasket is brought into close contact with the tubular sealer when the lid is closed.

The automatic opening/closing member includes a plurality of sliding blocks each coupled to the supplementary washing machine having a slot, a sliding projection placed in the slot so as to be movable along the slot when the lid is opened/closed, and a tension spring for elastically supporting the lid with respect to the supplementary washing machine.

The tension spring extends when the lid is closed, and returns to an original position when the lid is opened.

The slot is formed sloped upward in a stream line shape in a moving direction of the lid when the lid is closed.

The lid further includes a fastening groove formed along a contact surface to the tub.

The lid further includes a tubular sealer fastened to the fastening groove for sealing between the lid and the tub when the lid is closed.

The lid further includes a rib projected down from a length direction inside edge for being pressed by the supplementary washing machine when the supplementary washing machine is closed for returning the lid to an original position.

The gasket includes a first and second bent portions for making the gasket water tight, a first coupling edge extended from the first bent portion, and a second coupling edge extended from the second bent portion.

The first coupling edge is thicker than thickness of the first and second bent portions.

The first coupling edge is coupled to an upper side of the tub in a state the first coupling edge is pressed down by an outer tub cover which covers a top side of the tub.

The second coupling edge is coupled to a drawer cover which covers a top side of the drawer.

The gasket further includes a buckling preventive portion formed between the second coupling edge and the second bent portion for preventing noise and damage from taking place due to the buckling.

The buckling preventive portion is thicker than thickness of the first or second bent portions.

The gasket further includes clothe seizure preventive rib for preventing the laundry from seizing between the lid and an opening of the tub.

The clothe seizure preventive rib is projected outward toward the lid from between the second coupling edge and the buckling preventive portion.

The clothe seizure preventive rib is formed to have a length at which a portion thereof overlaps with the lid when the lid is closed.

The clothe seizure preventive rib is pressed down by the lid when the lid is closed and restored when the lid is opened.

In another aspect of the present invention, a washing machine includes a cabinet which forms an exterior of the washing machine, and a drawer removably mounted to a lower side of the cabinet, having a lid for introducing laundry and a tub for holding the laundry, wherein the lid is removably coupled to the drawer.

The drawer includes an automatic opening/closing member including a plurality of links which rotatably support the lid in opening/closing directions of the drawer, and a weight coupled to the link to exert gravity to the link for making the lid spaced apart from the tub when the drawer is opened, thereby opening/closing the lid when the drawer is opened/closed.

The automatic opening/closing member includes a plurality of links each having one end coupled to the cabinet and the other end coupled to a side of the lid for rotatably supporting the lid in opening/closing directions of the drawer, and a tension spring for supporting the lid with respect to the drawer, elastically.

The lid includes further includes a rib projected down from a length direction inside edge for being pressed by the drawer when the drawer is closed for returning the lid to an original position.

The tension spring extends when the lid is closed, and returns to an original position when the lid is opened.

The automatic opening/closing member includes a plurality of links for rotatably supporting the lid in opening/closing directions of the drawer, and a tension spring for supporting the link, elastically.

The link has one end coupled to the cabinet and the other end coupled to a side of the lid.

The tension spring has one end secured to a cabinet side coupling portion of the link, and the other end secured to one side of the cabinet such that the tension spring extends when the lid is closed, and returns to an original position when the lid is opened.

The drawer includes a plurality of projections from opposite sides of the drawer in opening/closing directions for pressing the link when the drawer is closed.

In another aspect of the present invention, a washing machine includes a cabinet which forms an exterior of the washing machine, a supplementary washing machine removably mounted to a lower side of the cabinet, having a lid for introducing laundry and a tub for holding the laundry, and an automatic opening/closing member for automatic opening/closing of the supplementary washing machine at the time the supplementary washing machine is opened/closed.

It is to be understood that both the foregoing general description and the following detailed description of the present invention are exemplary and explanatory and are intended to provide further explanation of the invention as claimed.

Advantageous Effects of Invention

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

BRIEF DESCRIPTION OF DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

At first, common elements of the washing machines in accordance with various embodiments of the present invention will be described.

Figure 1:
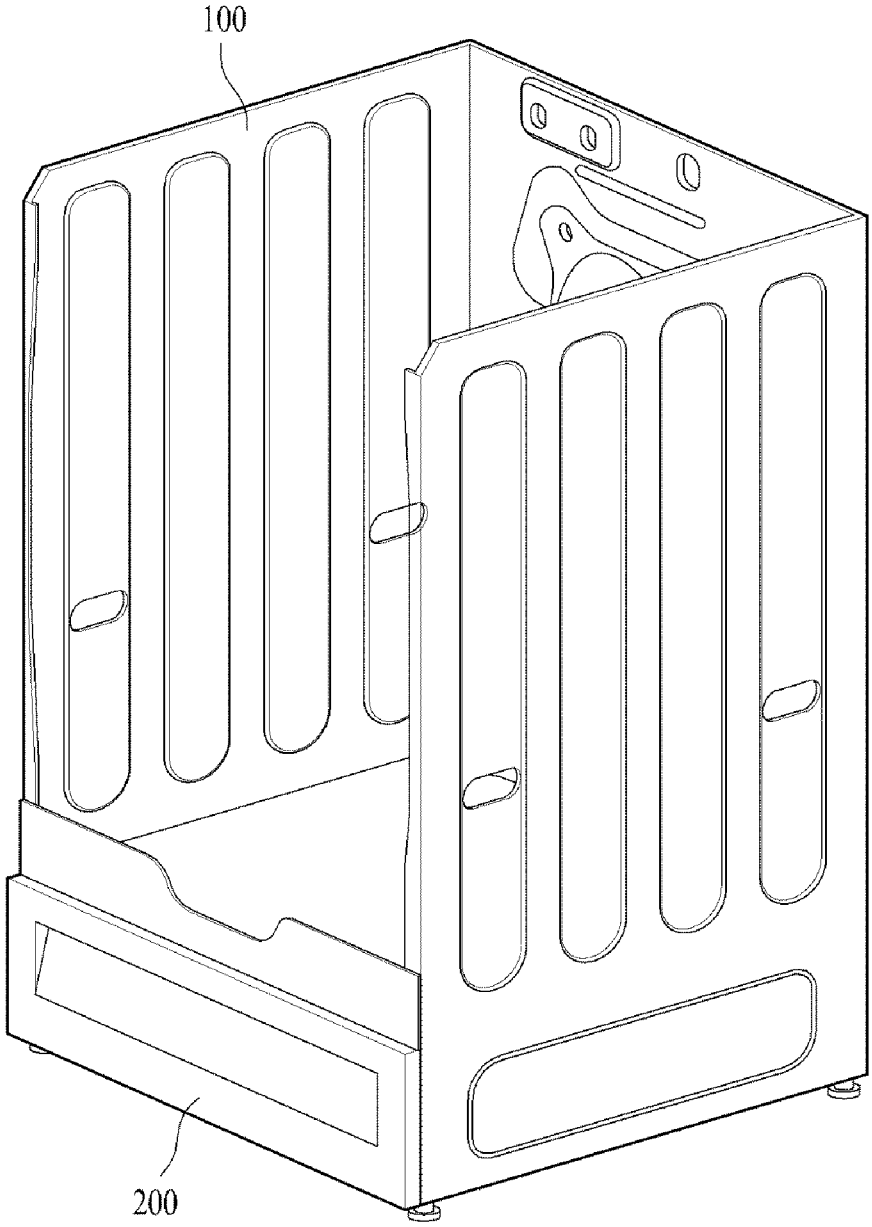
FIG. 1 illustrates a perspective view of a portion of a washing machine in accordance with a preferred embodiment of the present invention.
Figure 2:
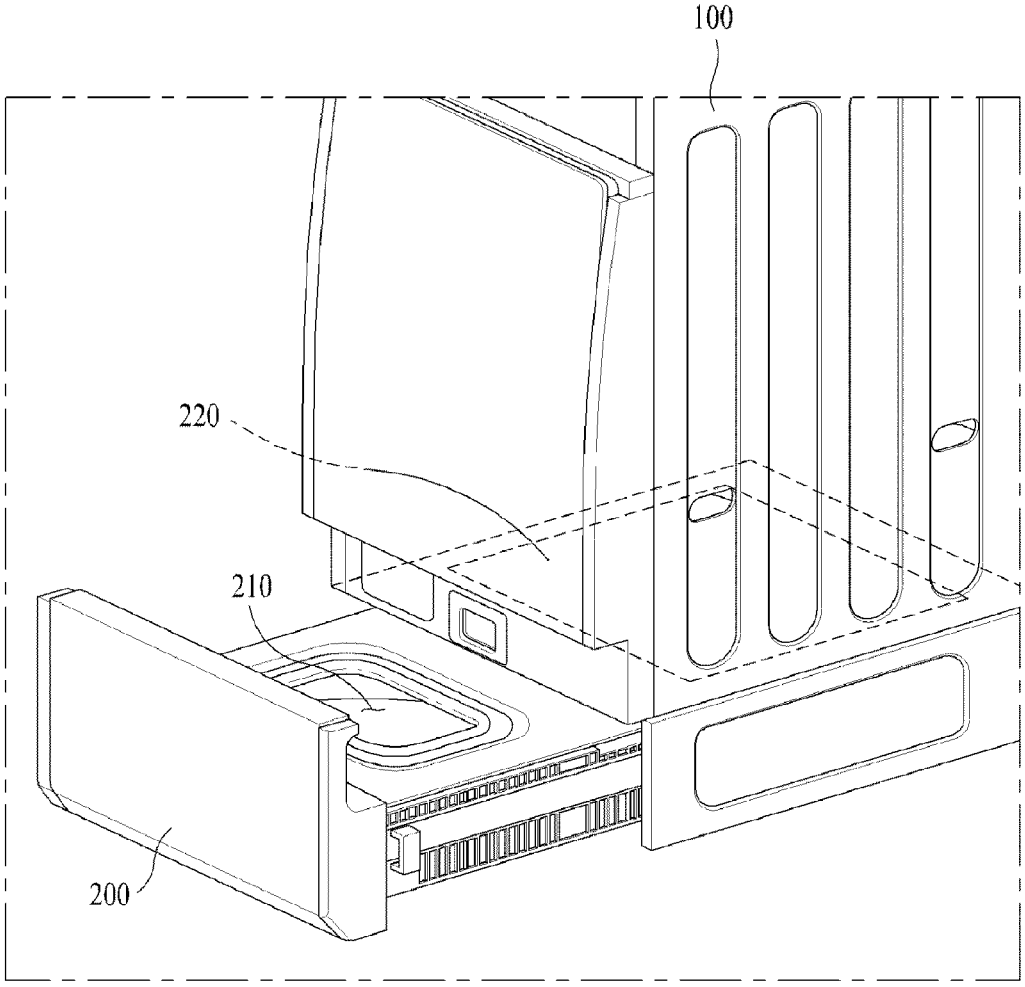
FIG. 2 illustrates a perspective view of a supplementary washing machine in accordance with a preferred embodiment of the present invention in an opened state.

FIG. 1 illustrates a perspective view of a portion of a washing machine in accordance with a preferred embodiment of the present invention, and FIG. 2 illustrates a perspective view of a supplementary washing machine in accordance with a preferred embodiment of the present invention in an opened state.

Referring to FIG. 1, the washing machine includes a cabinet 100 which forms an exterior of the washing machine, and a drawer type supplementary washing machine 200 on a lower side of the cabinet 100 removably mounted thereto. (Since the supplementary washing machine is suggested as one example of a drawer slidably mounted/dismounted to/from the cabinet, drawers recited in claims are described as the supplementary washing machines hereinafter, uniformly.

Referring to FIG. 2, the supplementary washing machine 200 includes a tub 210 for holding laundry, a drum 215 (See FIG. 14) rotatably mounted in the tub 210, and a lid 220 which is an inner clover for opening/closing the tub 210. The supplementary washing machine 200 is opened/closed by an automatic opening/closing member 300 which will be described later. In more detail, at the time the supplementary washing machine 200 is opened, the lid 220 is slidably opened/closed by the automatic opening/closing member 300.

The tub 210 has a top portion covered with an outer tub cover 212 except a laundry opening. A top of the outer tub cover 212 is covered with a drawer cover 200*a*, once more. A gasket 240 makes a gap between the outer tub cover 212 and the drawer cover 200*a* water-tight. The lid 220 is placed on the drawer cover 200*a* to close the opening in the tub 210 fully. A gap between the drawer cover 200*a* and the lid 220 are made water-tight by a tubular sealer 226 which will be described later (See FIG. 7).

Since the tub 210 shakes when the supplementary washing machine 200 is in operation, the gasket 240 is mounted for preventing washing water from overflowing to an outside of the tub 210. The gasket 240 is mounted along a circumference of the opening in the outer tub cover 212, has one side coupled to the outer tub cover 212, and the other side coupled to the drawer cover 200*a* (See FIG. 8).

The gasket 240 is brought into contact with the drawer cover 200*a* when the drawer cover 200*a* is closed to make the circumference of the opening water-tight. Or, the gasket 240 may be brought into contact with the tubular sealer 226 which will be described later when the lid 220 is closed. If the gasket 240 is brought into contact with the tubular sealer 226, the water tight is made by the gasket 240 for the first time, and the water tight is made by the tubular sealer 226 for the second time, thereby improving sealing efficiency.

Figure 13:
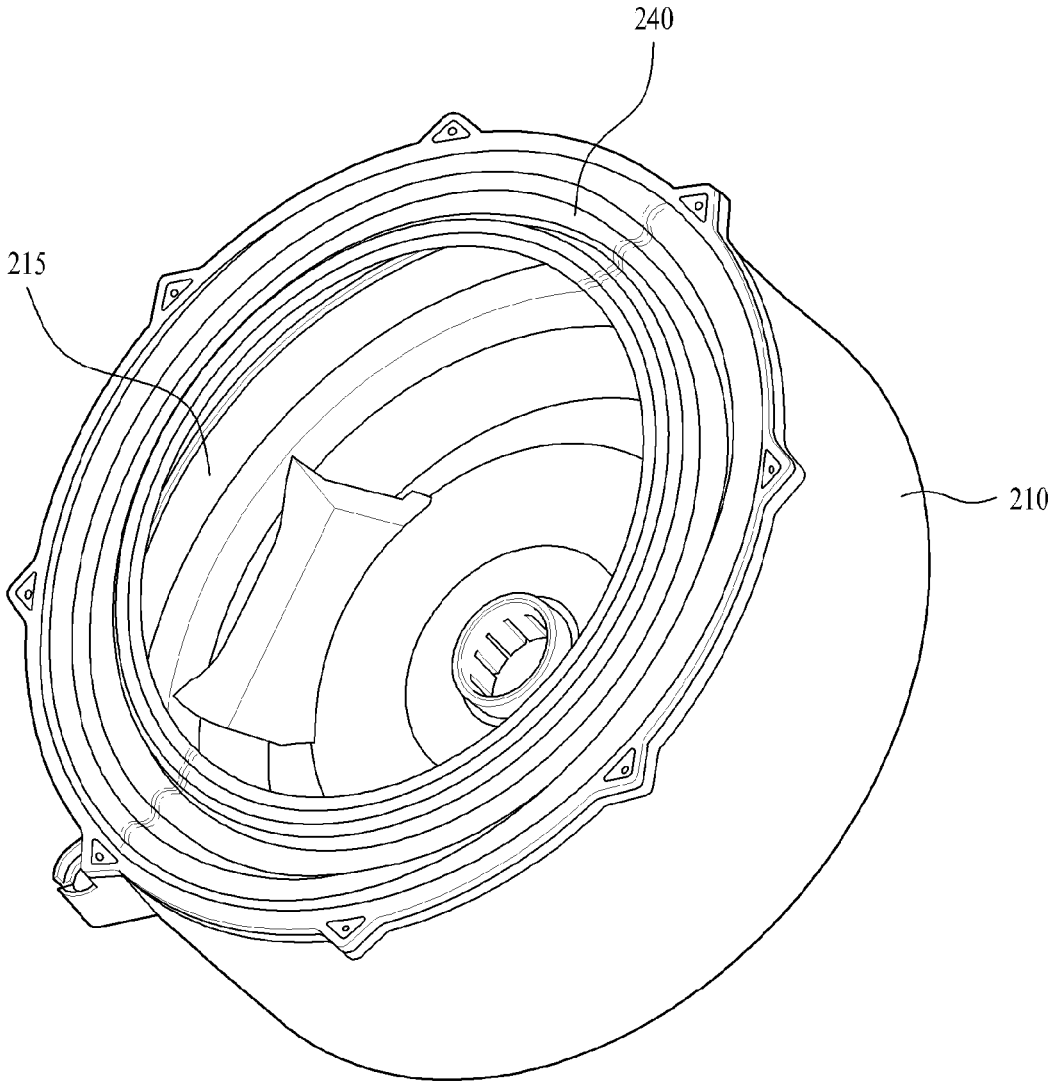
FIG. 13 illustrates a partial perspective view of a gasket in a supplementary washing machine in accordance with the present invention.
Figure 14:
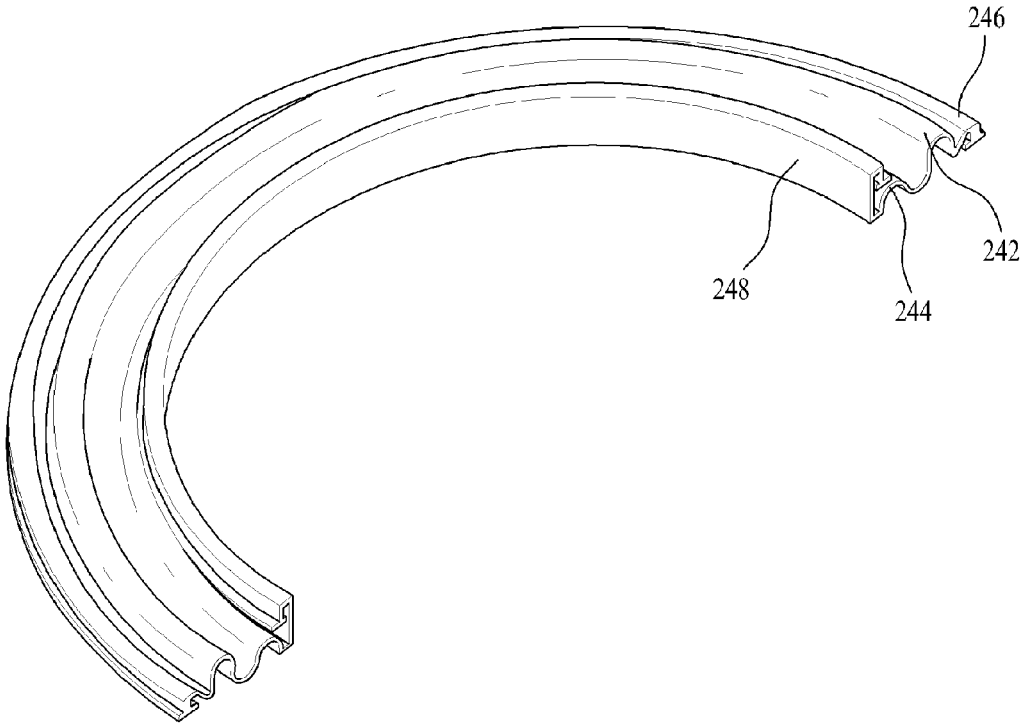
FIG. 14 illustrates a section showing a mounting state of the gasket at the time the lid on the supplementary washing machine in FIG. 1 is opened.
Figure 15:
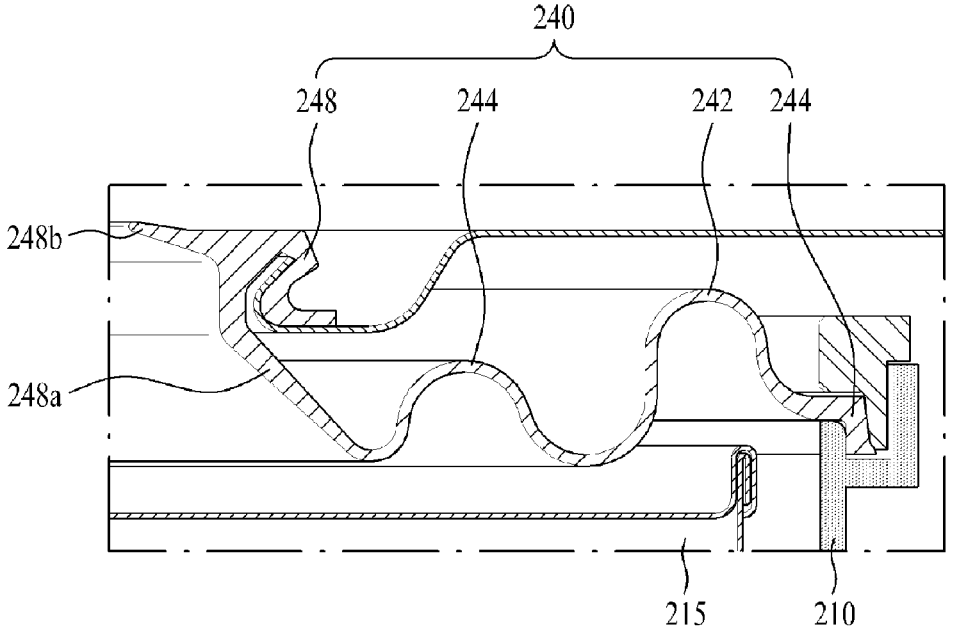
FIG. 15 illustrates a section showing a mounting state of the gasket at the time the lid on the supplementary washing machine in FIG. 1 is closed.

FIG. 13 illustrates a partial perspective view of a gasket in a supplementary washing machine in accordance with the present invention, FIG. 14 illustrates a section showing a mounting state of the gasket at the time the lid on the supplementary washing machine in FIG. 1 is opened, and FIG. 15 illustrates a section showing a mounting state of the gasket at the time the lid on the supplementary washing machine in FIG. 1 is closed.

The gasket 240 will be described in more detail with reference to FIGS. 13 to 15.

Referring to FIGS. 13 to 15, the gasket 240 includes a first bent portion 242 and a second bent portion 244 for sealing, a first coupling edge 246 coupled to the outer tub cover 212, and a second coupling edge 248 coupled to the drawer cover 200*a*.

The gasket 240 also has a buckling preventive portion 248*a* for preventing noise and damage from taking place due to the buckling, and a clothe seizure preventive rib 248*b* for preventing the laundry from seizing.

The first coupling edge 246 is formed thicker than thickness of the first bent portion 242 and the second bent portion 244. The first coupling edge 246, pressed down by the outer tub cover in a state seated on the opening of the tub, is coupled between the tub and the outer tub cover.

The second coupling edge 248, bent a plurality of times from the second bent portion 244, is coupled in a mode the second coupling edge 248 houses the edge of the drawer cover. The second coupling edge 248 is also formed thicker than the first bent portion 242 and the second bent portion 244, even thicker than thickness of the buckling preventive portion.

The buckling preventive portion is formed between the first coupling edge 246 and the second coupling edge 248 thicker than the thickness of the first bent portion 242 and the second bent portion 244

The buckling can be caused by vibration within a limited mounting space of the supplementary washing machine. The buckling can cause noise as the first bent portion 242 and the second bent portion 244 hit each other. If excessive buckling causes displacement, the gasket 240 is liable to damage due to the first bent portion 242 and the second bent portion 244 hitting one another, or interference with the drawer, the tub, or the drum in the vicinity of the gasket 240.

Therefore, in order to prevent the buckling from taking place and the gasket 240 from damaging, a portion having different stiffness is provided to the gasket 240 for reducing the buckling. The portion having different stiffness compared to adjacent portion is the very buckling preventive portion 248*a*.

The clothe seizure preventive rib 248*b* is positioned on an outside of a space between the second coupling edge 248 and the buckling preventive portion 248*a* projected toward the lid 220. In this instance, it is preferable that the clothe seizure preventive rib 248*b* is projected sloped upward. Moreover, the clothe seizure preventive rib 248*b* is formed to overlap with the lid 220 partially when the lid 220 is closed.

The clothe seizure preventive rib 248*b* prevents the laundry from seizing between the lid 220 and the gasket 240 when the lid 220 is opened/closed. That is, since the clothe seizure preventive rib 248*b* is pressed down to bend downward by the lid 220 when the lid 220 is closed, the seizure of the laundry between the lid 220 and the gasket 240 can be prevented. The clothe seizure preventive rib 248*b* returns to an original position when the lid 220 is opened.

A washing machine in accordance with a first preferred embodiment of the present invention will be described.

Figure 3:
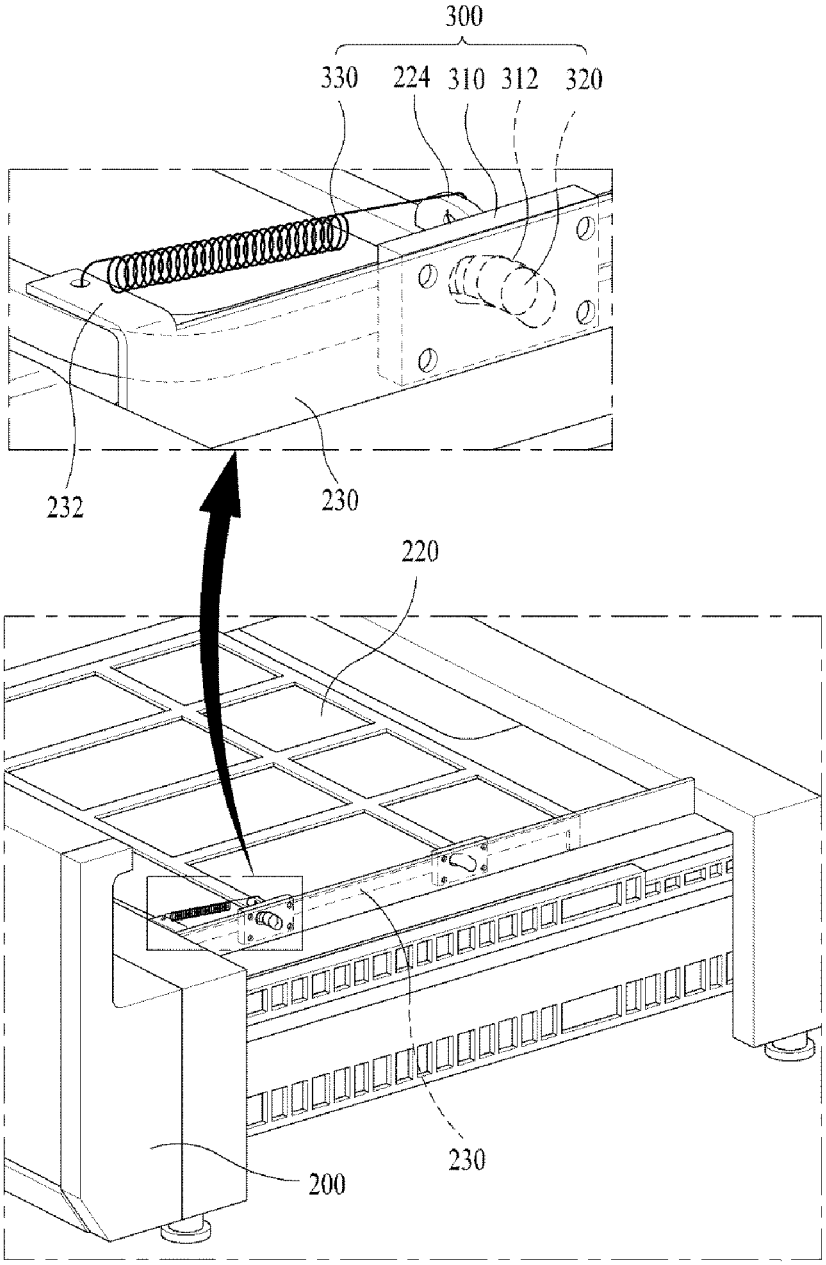
FIG. 3 illustrates a perspective view of a supplementary washing machine in accordance with a first preferred embodiment of the present invention.
Figure 4:
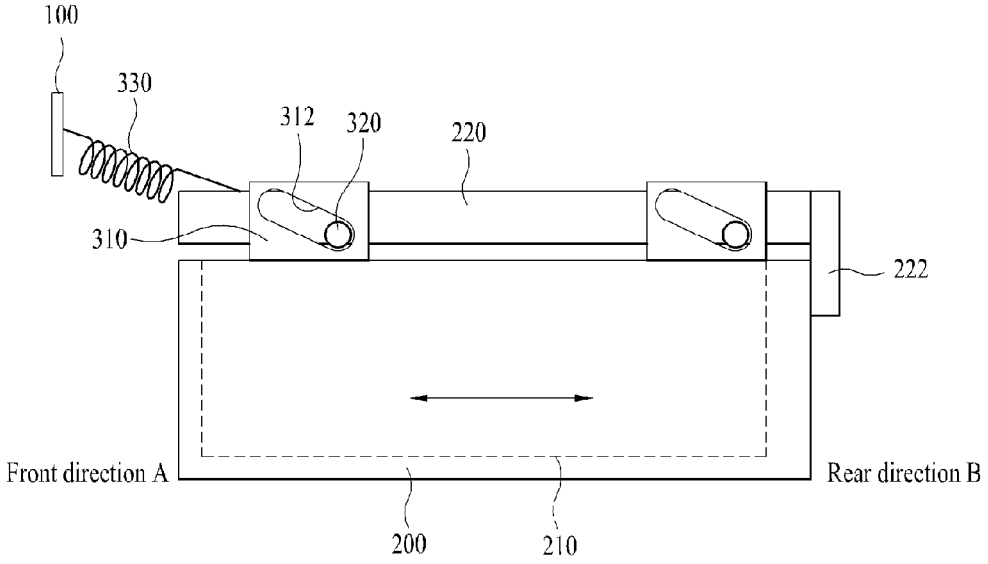
FIG. 4 illustrates a side view of the supplementary washing machine in FIG. 3, schematically.
Figure 5:
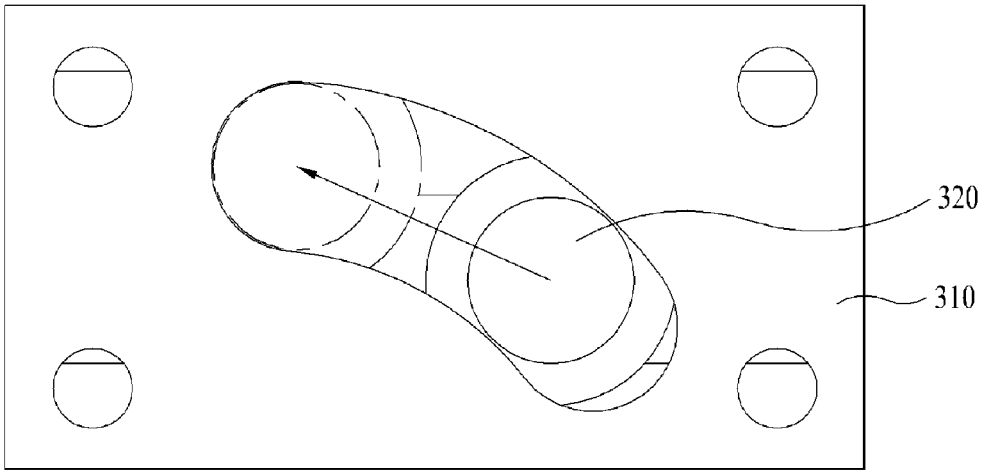
FIG. 5 illustrates an operational diagram showing an operation state of a sliding projection when the supplementary washing machine in FIG. 3 is closed.
Figure 6:
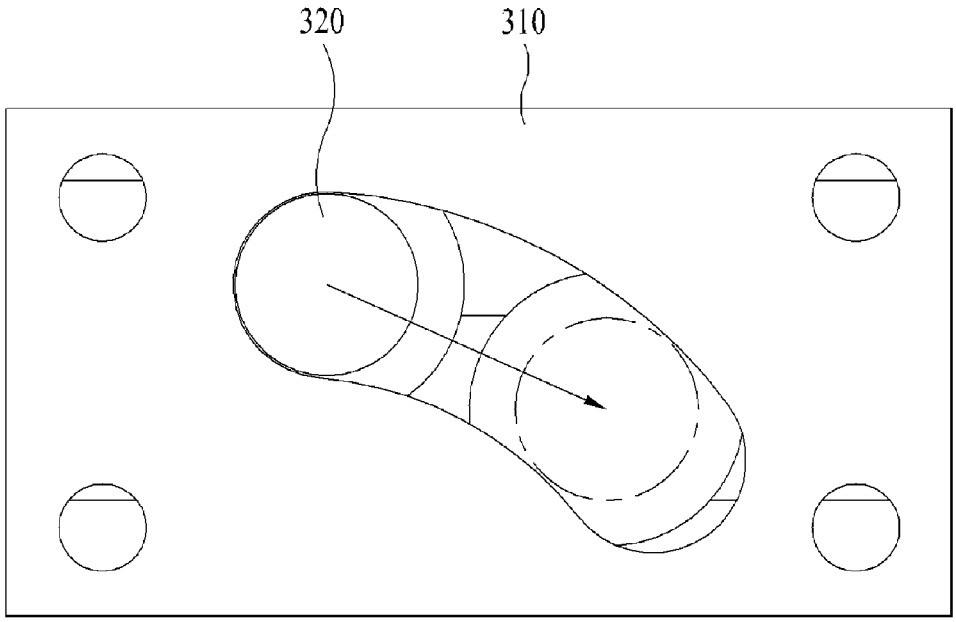
FIG. 6 illustrates an operational diagram showing an operation state of a sliding projection when the supplementary washing machine in FIG. 3 is opened.
Figure 7:
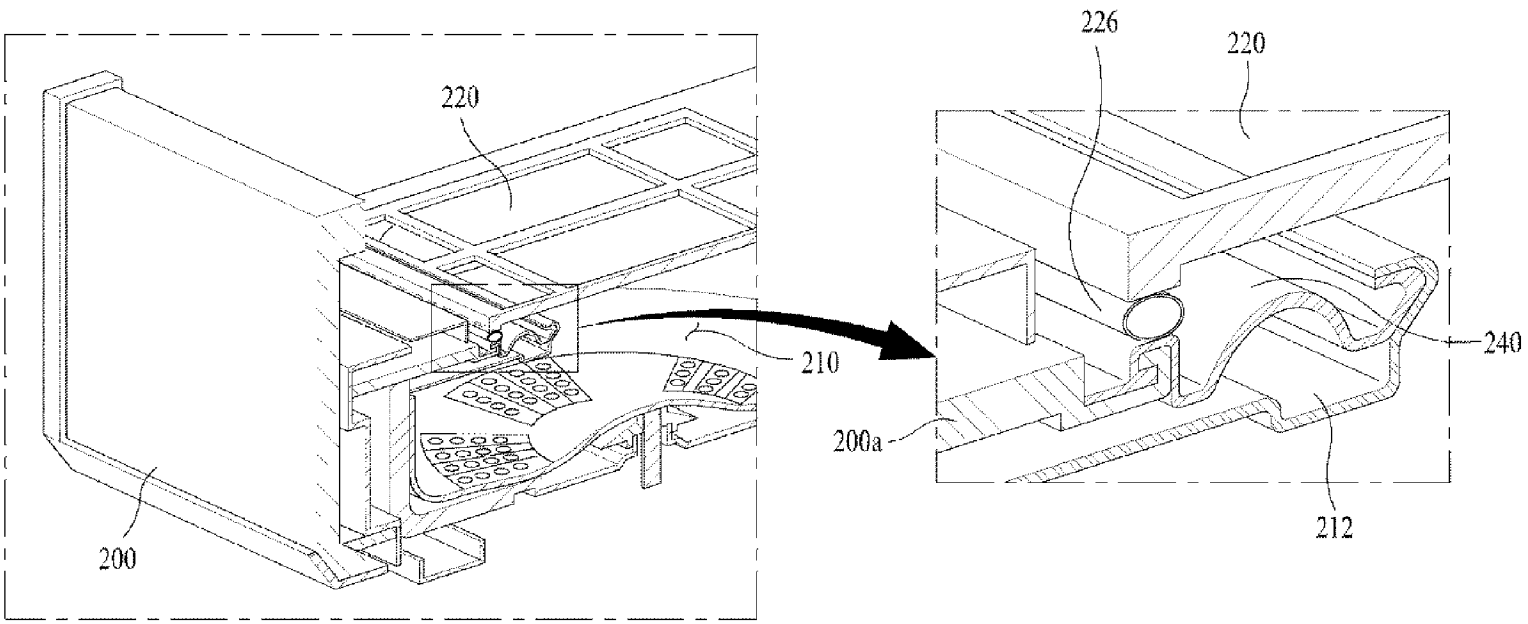
FIG. 7 illustrates a perspective view of a supplementary washing machine of the present invention, partially.
Figure 8:
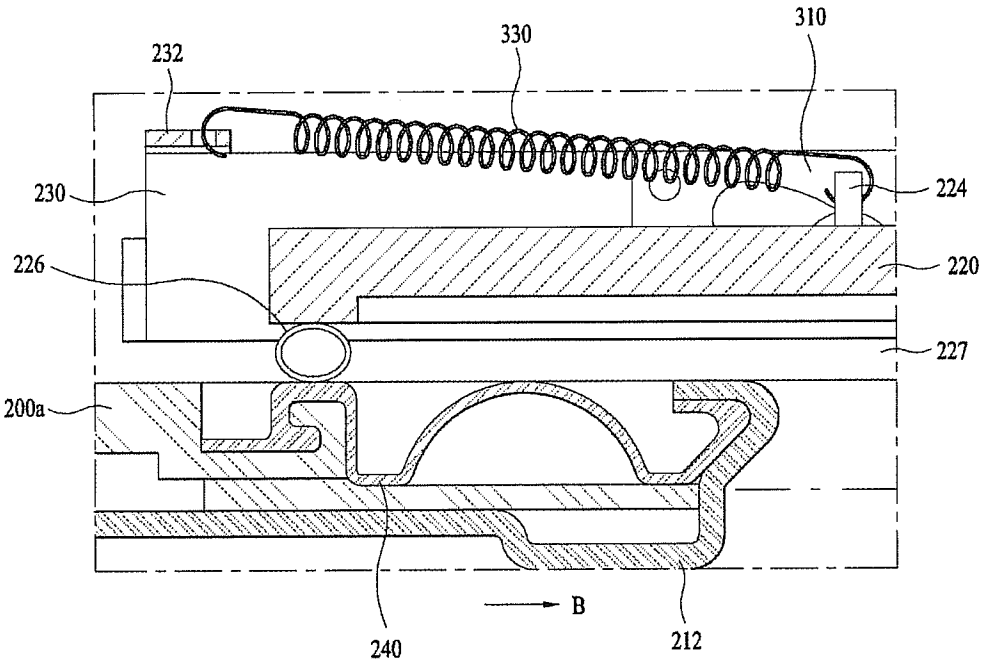
FIG. 8 illustrates a diagram showing a sealing structure when the supplementary washing machine in FIG. 7 is closed.
Figure 9:
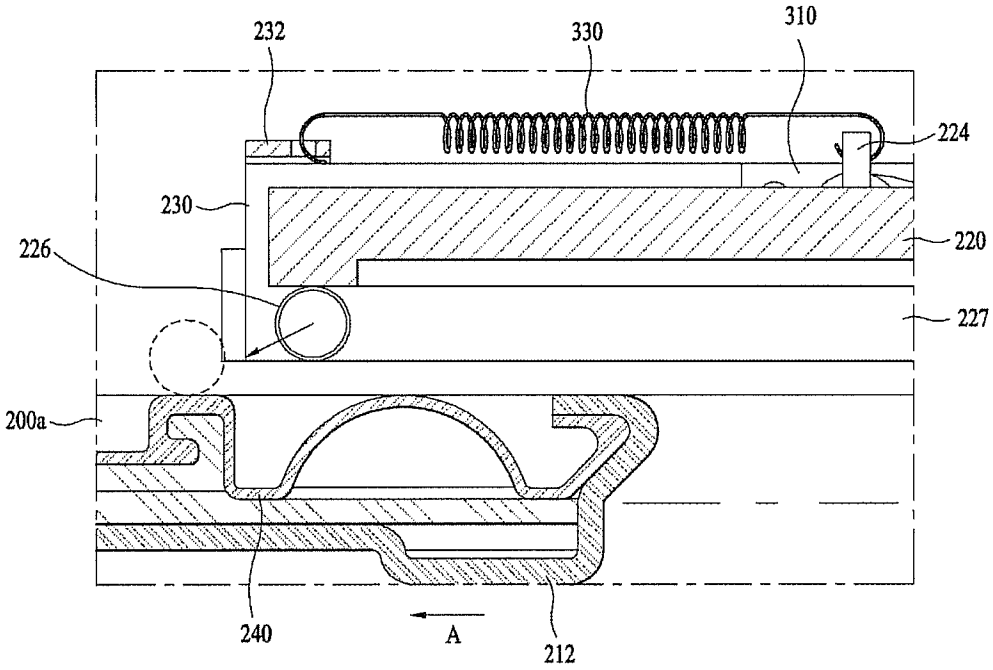
FIG. 9 illustrates a diagram showing a sealing structure when the supplementary washing machine in FIG. 7 is opened.

FIG. 3 illustrates a perspective view of a supplementary washing machine in accordance with a first preferred embodiment of the present invention, and FIG. 4 illustrates a side view of the supplementary washing machine in FIG. 3, schematically. FIG. 5 illustrates an operational diagram showing an operation state of a sliding projection when the supplementary washing machine in FIG. 3 is closed, and FIG. 6 illustrates an operational diagram showing an operation state of a sliding projection when the supplementary washing machine in FIG. 3 is opened. FIG. 7 illustrates a perspective view of a supplementary washing machine of the present invention partially, FIG. 8 illustrates a diagram showing a sealing structure when the supplementary washing machine in FIG. 7 is closed, and FIG. 9 illustrates a diagram showing a sealing structure when the supplementary washing machine in FIG. 7 is opened.

Referring to FIG. 3, the supplementary washing machine 200 has a lid 220 fastened to a top side for opening/closing the tub 210. The lid 220 is slidably opened/closed by the automatic opening/closing member 300.

It is preferable that the lid 220 is formed to have a size larger than the opening such that the lid 220 can cover the opening in the tub 210, adequately. The lid 220 has a spring holder 224 on one side of an upper side for holding one end of a tension spring to be described later. The lid 220 also has a fastening groove 227 formed in an underside along a surface to be brought into contact with the top side of the tub 210, more specifically, with the drawer cover 200*a*.

The fastening groove 227 has the tubular sealer 226 fastened thereto for sealing between the lid 220 and the tub 210 when the lid 220 is closed. It is preferable that the lid 220 is mounted such that the tubular sealer 226 is slightly pressed down so as to be in close contact with the drawer cover 200*a* when the lid 220 is closed for the tubular sealer to make easy water tight between the lid 220 and the tub 210.

In the meantime, the lid 220 has a rib 222 projected down from a rear edge.

Referring to FIG. 4, the rib 222 is brought into contact with a rear side of the supplementary washing machine 200 when the user pushes the supplementary washing machine 200 into the cabinet 100 at the time the user closes the supplementary washing machine 200. As the supplementary washing machine 200 is being pushed into the cabinet 100, the supplementary washing machine 200 pushes the rib 222. According to this, the lid 220 returns to an original position as the lid 220 is pushed toward a rear side of an inside of the cabinet 100 (This will be described later).

Referring to FIG. 3, the automatic opening/closing member 300 includes a plurality of sliding blocks 310 each coupled to one side of the cabinet 100 having a slot 312, a sliding projection 320 placed in the slot 312 so as to be movable along the slot 312 when the lid 220 is opened/closed, and a tension spring 330 for elastically supporting the lid 220 with respect to the supplementary washing machine 200.

The sliding block 310 is fastened to one side of the cabinet 100, more specifically, to a bracket 230 fixed to the cabinet 100. The plurality of sliding blocks 310 are fastened to opposite sides of the cabinet 100 along opening/closing directions of the supplementary washing machine 200. The sliding blocks 310 are fastened to sides of a front side and a rear side of the supplementary washing machine 200.

At a front end of the bracket 230, there is a spring holder 232 for securing one end of the tension spring 330 described later. Each of the sliding blocks 310 has the slot 312 passed therethrough.

Referring to FIGS. 5 and 6, the slot 312 is formed sloped upward in a stream line with respect to a moving direction of the lid 220 when the supplementary washing machine 200 is closed. If the slot 312 is formed parallel to a moving direction of the lid 220, the lid 220 may interfere with the supplementary washing machine 200 when the supplementary washing machine 200 is drawn out. Therefore, if the slot 312 is sloped upward, the lid 220 and the supplementary washing machine 200 are spaced apart at the time the supplementary washing machine 200 is drawn out, thereby permitting interference between the lid 220 and the supplementary washing machine 200, making easy drawing out of the supplementary washing machine 200.

Referring to FIG. 3, the sliding projections 320 are projected from both sides of the lid 220 along a moving direction of the supplementary washing machine 200. The sliding projection 320 moves following the slot 312 in a state the sliding projection 320 is placed in the slot 312 at the time the supplementary washing machine 200 is opened/closed. Depending on a stopping position of the sliding projection 320 after the sliding projection 320 moves following the slot 312, the lid 220 is opened or closed.

The tension spring 330 has one end secured to the spring holder 232 at the bracket 230, and the other end secured to the spring holder 224 at the lid 220. The tension spring 330 is mounted such that the tension spring 330 extends when the lid 220 closes the tub 210, and returns to an original position when the tub 210 is opened.

The automatic opening/closing of the lid and the operation of the automatic opening/closing member in the supplementary washing machine in accordance with the first preferred embodiment of the present invention will be described (For convenience' sake, the drawing out direction of the supplementary washing machine will be defined as a front direction and indicated as A direction, and the placing in direction of the supplementary washing machine will be defined as a rear direction and indicated as B direction).

Referring to FIG. 4, the supplementary washing machine 200 is drawn out in the A direction, or placed in the B direction. Since the force pressing the rib 222 is removed if the supplementary washing machine 200 is drawn out in the A direction, the tension spring 330 returns to an original position. By the returning force of the tension spring 330, the lid 220 is pulled in the A direction.

In this instance, referring to FIG. 5, since the sliding projection 320 moves upward following the slot 312, the lid 220 also slidably moves as shown in FIG. 9. According to this, the lid 220 moves up away from the supplementary washing machine 200. Therefore, if the supplementary washing machine 200 is drawn out, the lid 220, which is an inner cover, is opened, enabling to draw out the tub 210 in an opened state.

Opposite to this, if the supplementary washing machine 200 is placed in the B direction, the supplementary washing machine 200 presses the rib 222 to push the rib 222, the tension spring 330 extends. As the rib 222 is pushed in the B direction, the sliding projection 320 moves downward following the slot 312 as shown in FIG. 6.

In this instance, referring to FIG. 8, following the movement of the sliding projection 320, the lid 220 also slidably moves down toward the supplementary washing machine 200 until the lid 220 is closed. At the same time with this, since the tubular sealer 226 is brought into close contact with the drawer cover 200*a*, a gap between the tub 210 and the lid 220 becomes water tight. Thus, because the lid 220 is closed automatically if the supplementary washing machine 200 is closed, convenience of use is improved.

A supplementary washing machine in accordance with a second preferred embodiment of the present invention will be described.

Figure 10:
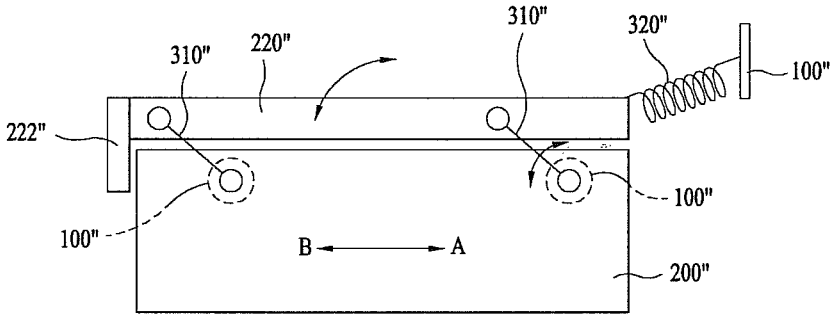
FIG. 10 illustrates a side view of a supplementary washing machine in accordance with a second preferred embodiment of the present invention, schematically.

FIG. 10 illustrates a side view of a supplementary washing machine in accordance with a second preferred embodiment of the present invention, schematically.

Referring to FIG. 10, the supplementary washing machine 200" includes a lid 220" which is an inner cover, and an automatic opening/closing member for opening/closing the lid" automatically.

The lid 220" opens the tub (not shown) when the lid 220" is drawn by the automatic opening/closing member in the A direction of the supplementary washing machine 200" and closes the tub when the lid 220" returns in the B direction of the supplementary washing machine 200" to an original position. The lid 220" has a rib 222" projected down from a rear edge.

Alike the first embodiment, at the time of closing the supplementary washing machine 200" if the user pushes the supplementary washing machine 200" into the cabinet 100" the rib 222" is brought into contact with a rear side of the supplementary washing machine 200". As the supplementary washing machine 200" moves in the B direction, the supplementary washing machine 200" presses the rib 222" to push the rib 222". As the rib 222" is pushed, the lid 220" is pushed toward the B direction of the cabinet 100" until the lid 220" is returned to an original position to close the tub.

The automatic opening/closing member includes a plurality of links 300" which rotatably support the lid 220" in opening/closing directions of the supplementary washing machine 200", and a tension spring 320" which supports the links 300" with respect to the supplementary washing machine 200", elastically.

The links 300" are mounted to a front and a rear of sides of the supplementary washing machine 200" in the opening/closing direction of the supplementary washing machine 200". In this instance, the link 300" has one end rotatably coupled to the cabinet 100" and the other end rotatably coupled to a side of the lid 220".

The tension spring 320" has one end secured to the cabinet 100" and the other end secured to a front edge of the lid 220". The tension spring 320" is mounted such that the tension spring 320" extends when the lid 220" closes the tub, and returns to an original position when the lid 220" opens the tub.

Accordingly, if the user opens the supplementary washing machine 200" in the A direction, the force pressing the rib 222" is removed. Therefore, by the returning force of the tension spring 320", the lid 220" slidably moves toward the A direction.

Referring to FIG. 10, since the lid 220" is supported on the link 300" having one end coupled to the cabinet 100", the lid 220" moves upward toward the tension spring 320" at the same time with moving toward the A direction. Accordingly, the lid 220" is spaced apart from the supplementary washing machine 200", making the tub exposed in an opened state at the time the supplementary washing machine 200" is drawn out.

Opposite to this, if the user moves the supplementary washing machine 200" in the B direction, the rear side of the supplementary washing machine 200" pushes the rib 222". As the rib 222" is pushed, the tension spring 320" extends, returning the lid 220" to an original position. According to this, the tub is closed in a state the supplementary washing machine 200" is placed in the cabinet 100". The tub is made water tight by a gasket (not shown) and a tubular sealer (not shown) identical to the ones in the first embodiment.

A supplementary washing machine in accordance with a third preferred embodiment of the present invention will be described.

Figure 11:
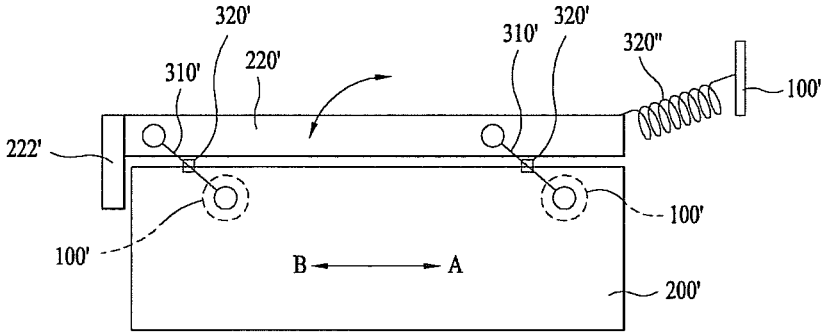
FIG. 11 illustrates a side view of a supplementary washing machine in accordance with a third preferred embodiment of the present invention, schematically.

FIG. 11 illustrates a side view of a supplementary washing machine in accordance with a third preferred embodiment of the present invention, schematically.

Referring to FIG. 11, the supplementary washing machine 200' includes a lid 220' having a rib 222', and an automatic opening/closing member for opening/closing the lid', automatically.

The automatic opening/closing member includes a plurality of links 300' which rotatably support the lid 220' in opening/closing directions of the supplementary washing machine 200' and a weight for exerting gravity to the link 300' for making the lid 220' spaced apart from the tub (not shown).

The link 300' has one end rotatably coupled to a side of the lid 220', and the other end rotatably coupled to the cabinet 100'.

Since the rear side of the supplementary washing machine 200' is pressing the rib 222' when the supplementary washing machine 200' is in closed position, a state can be maintained, in which the lid 220' closes the tub 210'. However, if the supplementary washing machine 200' moves in the A direction, a force pressing the rib 222' is removed. Accordingly, the link 300' rotates by the gravity of the weight 320', moving the lid 220' upward. According to this, since the lid 220' moves away from the supplementary washing machine 200', the tub is exposed in an opened state.

A supplementary washing machine in accordance with a fourth preferred embodiment of the present invention will be described.

Figure 12:
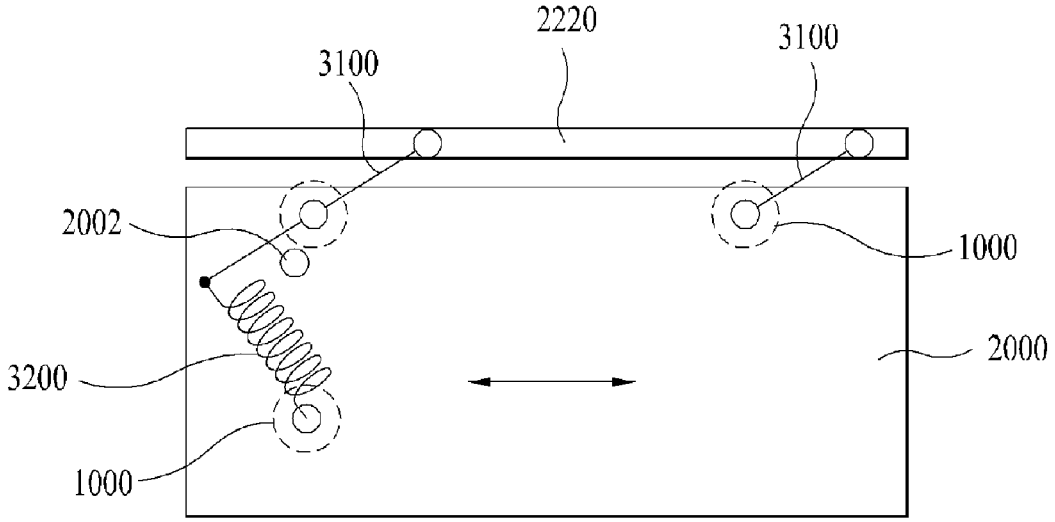
FIG. 12 illustrates a side view of a supplementary washing machine in accordance with a fourth preferred embodiment of the present invention, schematically.

FIG. 12 illustrates a side view of a supplementary washing machine in accordance with a fourth preferred embodiment of the present invention, schematically.

Referring to FIG. 12, the supplementary washing machine 2000 includes a lid 2200 for opening/closing a tub (not shown), a plurality of links 3100 for rotatably supporting the lid 2200 in opening/closing directions of the supplementary washing machine 2000, a tension spring 3200 for elastically supporting the links 3100, and a plurality of projections 2002 for pressing the links 3100.

The tension spring 3200 is mounted such that the tension spring 3200 extends when the lid 2200 closes the tub, and the tension spring 3200 returns to an original position when the tub is opened.

The links 3100 has a type in which one end thereof is coupled to a side of the lid 2200 and the other end is coupled to the cabinet 1000, and the other type in which one end thereof is coupled to a side of the lid 2200, the other end is coupled to the tension spring 3200, and a middle is coupled to the cabinet 1000, used together.

The link 3100 coupled to the tension spring 3200 is mounted to a rear of a side of the supplementary washing machine 2000. The link 3100 that is not coupled to the tension spring 3200 is mounted to a front of the side of the supplementary washing machine 2000.

The link 3100 mounted to the rear of the supplementary washing machine 2000 has a portion between a point thereof coupled to the tension spring 3200 and a point thereof coupled to the cabinet 100 pushed by the projection 2002 when the supplementary washing machine 2000 is moved in the B direction. That is, as the supplementary washing machine 2000 moves in the B direction, the projection 2002 pushes the rear side link 3100 such that the lid 2200 closes the tub.

If the supplementary washing machine 2000 is opened in the A direction, a force pressing the link 3100 is removed. Accordingly, the tension spring 3200 is returned, rotating the rear side link 3100. The link 3100 pushes up the lid 2200 as the link 3100 rotates, and the lid 2200 moves in the B direction as well as upward, such that the lid 2200 is spaced away from the supplementary washing machine 2000. According to this, the tub can be exposed in an opened state.

As has been described, the washing machine of the present invention has the following advantage.

The automatic opening/closing of the lid at the time of opening/closing of the supplementary washing machine improves convenience of the user.

The invention claimed is:

1. A washing machine comprising:

a cabinet which forms an exterior of the washing machine;

a supplementary washing machine having a drawer removably mounted to a lower side of the cabinet, a tub for holding laundry, and a lid for introducing the laundry to the tub wherein the tub includes a top portion covered with an outer tub cover except for an opening formed in the top portion, a drawer cover that covers a peripheral portion of the outer tub cover, and a gasket disposed between the outer tub cover and the drawer cover to form a seal, and wherein the lid is slidably disposed on the drawer cover to close the opening in the tub, wherein the lid further includes a rib projected downwardly from a length direction inside edge to be pressed by the supplemental washing machine when the supplementary washing machine is closed to return the lid to an original position; and an automatic opening/closing member to slidably open/close the lid at the time the supplementary washing machine is opened/closed, wherein the automatic opening/closing member includes a plurality of sliding blocks fastened to a bracket that is fixed to the cabinet, the sliding block having a slot, a plurality of sliding projections extend from opposite sides of the lid, and a tension spring to elastically support and bias the lid with respect to the tub, wherein the sliding projection is disposed in the slot so as to be movable along the slot when the lid is opened/closed, and wherein the bracket is located vertically between two parallel frames which are horizontally disposed with respect to the bracket.

2. The washing machine as claimed in claim 1, wherein the gasket mounted is along a circumference of the opening through which the laundry is introduced, to prevent washing water from leaking to an outside of the tub.

3. The washing machine as claimed in claim 2, wherein the lid includes a tubular sealer to seal between the tub and the lid when the lid is closed.

4. The washing machine as claimed in claim 3, wherein the gasket is brought into close sealing contact with the tubular sealer when the lid is closed.

5. The washing machine as claimed in claim 2, wherein the gasket includes;

a first and second bent portions to make the gasket water tight, a first coupling edge extended from the first bent portion, and a second coupling edge extended from the second bent portion.

6. The washing machine as claimed in claim 5, wherein the first coupling edge is thicker than a thickness of the first or second bent portions.

7. The washing machine as claimed in claim 6, wherein the first coupling edge is coupled to an upper side of the tub in a state the first coupling edge is pressed down by the outer tub cover which covers a top side of the tub.

8. The washing machine as claimed in claim 5, wherein the second coupling edge is coupled to a drawer cover which covers a top side of the drawer.

9. The washing machine as claimed in claim 8, wherein the gasket further includes a buckling preventive portion formed between the second coupling edge and the second bent portion for preventing noise and damage from taking place due to the buckling.

10. The washing machine as claimed in claim 9, wherein the budding preventive portion is thicker than thickness of the first and second bent portions.

11. The washing machine as claimed in claim 9, wherein the gasket further includes a clothe seizure preventive rib to prevent the laundry from seizing between the lid and the opening of the tub.

12. The washing machine as claimed in claim 11, wherein the clothe seizure preventive rib projects outward toward the lid from between the second coupling edge and the buckling preventive portion.

13. The washing machine as claimed in claim 12, wherein the clothe seizure preventive rib has a length at which a portion thereof overlaps with the lid when the lid is closed.

14. The washing machine as claimed in claim 13, wherein the clothe seizure preventive rib is pressed down by the lid when the lid is closed and restored when the lid is opened.

15. The washing machine as claimed in claim 1, wherein the tension spring extends when the lid is closed, and returns to an original position when the lid is opened.

16. The washing machine as claimed in claim 1, wherein the slot is formed sloped upward in a moving direction of the lid when the lid is closed.

17. The washing machine as claimed in claim 1, wherein the lid further includes a fastening groove formed along a contact surface to the tub.

18. The washing machine as claimed in claim 17, wherein the lid further includes a tubular sealer fastened to the fastening groove to form a seal between the lid and the tub when the lid is closed.

* * * * *